US005694791A

United States Patent [19]

Esposito

[11] Patent Number: 5,694,791

[45] Date of Patent: Dec. 9, 1997

[54] APPARATUS FOR FORMING A JEWELRY ITEM

[75] Inventor: Joseph Esposito, Warwick, R.I.

[73] Assignee: Primetime Mfg., Inc., Warwick, R.I.

[21] Appl. No.: 626,322

[22] Filed: Apr. 2, 1996

[51] Int. Cl.[6] ..... A44C 5/02

[52] U.S. Cl. ..... 63/3; 63/4

[58] Field of Search ..... 63/3, 4, 9, 10, 63/11, 26, 27, 28, 31, 29.1; 89/896.4, 896.411, 896.42, 10

[56] References Cited

U.S. PATENT DOCUMENTS

| | | | |
|---|---|---|---|
| 1,476,462 | 12/1923 | Pejchar | 63/26 |
| 2,521,006 | 9/1950 | Hamilton | 63/9 |
| 3,629,571 | 12/1971 | Schonbek | 63/4 X |
| 4,781,038 | 11/1988 | Branca et al. | 63/26 |
| 5,077,988 | 1/1992 | Pöll | 63/26 |

*Primary Examiner*—Kien T. Nguyen

*Attorney, Agent, or Firm*—Levisohn, Lerner, Berger & Langsam

[57] ABSTRACT

An article of manufacture and method for joining individual elements of a jewelry necklace or bracelet without using soldering. A connecting member, similar to a staple, is provided and metal forming processes are employed allowing the legs of the staple to pass through a hole formed between parallel rails in the respective basket settings with the legs being thereafter bent to connect and secure the respective basket settings.

10 Claims, 1 Drawing Sheet

APPARATUS FOR FORMING A JEWELRY ITEM

BACKGROUND OF THE INVENTION

A method and apparatus for connecting individual jewel settings together to form a plurality of linked settings such as for use in a bracelet, necklace or the like.

In conventional prior art jewelry, a setting such as a setting box is employed onto which a precious or non-precious stone is mounted or set. Each box is joined to an adjoining box, to form a necklace or bracelet, with rings or similar joining members. In particular, each setting box has rings on both ends. A ring from one end of a setting box is looped into the ring of the proximal end of an adjoining setting box, and solder is employed to close the connecting ring. Where bracelets, necklaces or earrings are formed of a plurality of setting boxes joined end to end, significant labor costs are involved.

An object of this invention is to employ modern automated metal forming processes to quickly and inexpensively form a chain of setting members, joined together, as in bracelets, necklaces or the like.

Another object of this invention is to provide such a jewelry item in which labor charges are materially reduced.

Yet another object of this invention is to provide a method and resulting article of manufacture formed from multiple links of jewelry which are used to set stones in which large numbers of such links may be quickly, efficiently and inexpensively joined together.

Yet another object of this invention is to provide such a method and resulting article of jewelry which is capable of being produced by employees with low skills, especially those less than the fine craftsman normally employed as jewelers.

Other objects, advantages and features of this invention become more apparent with the following description.

SUMMARY OF THE INVENTION

In accordance with the teachings of this invention, the above objects are accomplished by providing a method and a connecting device for forming a jewelry item comprised of basket settings for setting/holding a jewelry stone, the basket settings being joined together to form a plurality of linked basket settings. The connector member and method utilize basket settings having substantially identical opposite ends with the stone held in the basket. The ends of the basket settings comprise parallel rail members and connector members join adjacent rail members of the basket settings through a metal forming automated process which bends the legs of the connector around the rails to connect the basket settings together in a chain-like manner.

DETAILED DESCRIPTION OF THE DRAWINGS AND THE PREFERRED EMBODIMENT

Figure 1:
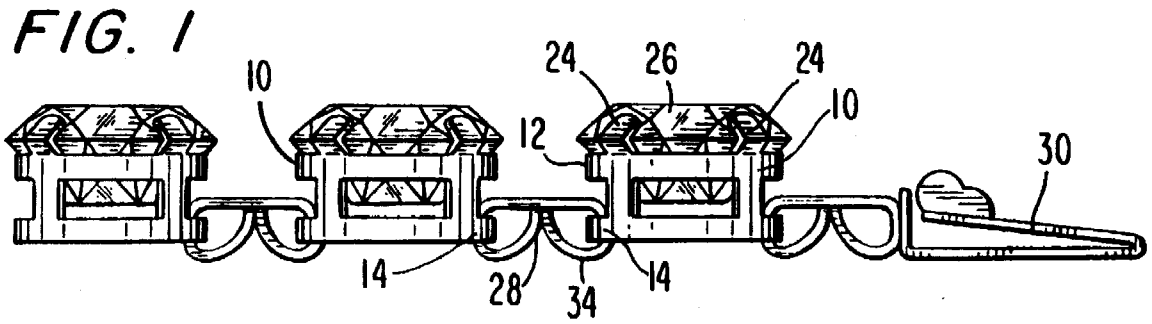
FIG. 1 is an end view of three basket settings, connecting members and one end of a clasp of this invention.
Figure 2:
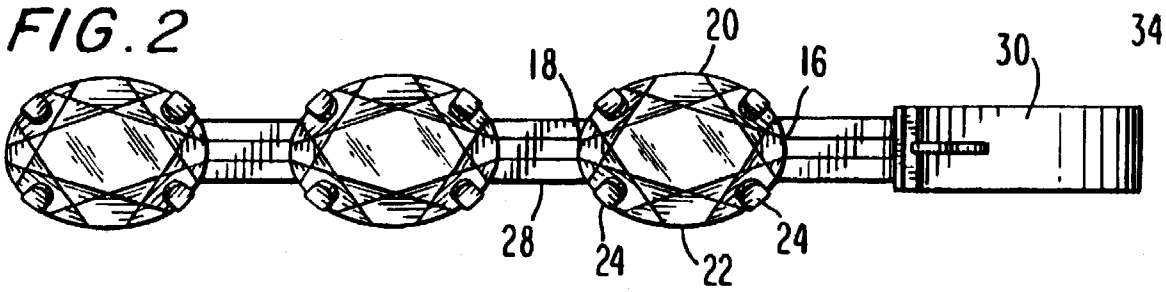
FIG. 2 is a top view of the bracelet portion of FIG. 1.

FIG. 1 illustrates a basket setting 10 having a circumferential upper railing 12 and lower railing 14. The basket setting generally has ends 16 and 18 and sides 20 and 22. Prongs 24 on the sides 20 and 22 hold respective stones 26 in place whether precious or non-precious. A connecting member 28, similar in profile to a staple, connects adjoining basket settings 10 by having their legs pass over lower railings 14, i.e., in the hole found between the upper railing 12 and lower railing 14. One end of a bracelet formed of a plurality of connected basket settings terminates with a conventional clasp 30, the other end of which is a conventional clasp closing member and is not shown.

There is sufficient clearance between connector 28 and the hole defined between lower railing 14 and upper railing 12 for the basket setting so that the connectors and settings are relatively movable with respect to each other, even when connected together.

Figure 3:
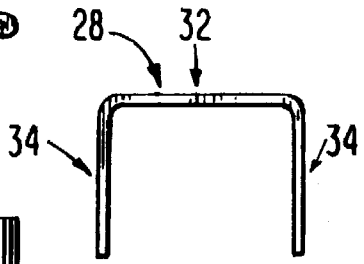
FIG. 3 is a side view of the connecting member before it is metal formed to join adjacent basket settings.

The width of the connecting member 28 is at least half as great as the distance between the sides 20 and 22 of basket setting 10. As shown in FIG. 3, each connecting member generally has a flat base 32 and downwardly extending legs 34 which project substantially in the same direction as one another and away from base 32. A metal forming machine is employed to join adjacent basket settings with connectors 28, by bending legs 34 towards each other and then upwardly towards base 32 in a way similar to closing a staple to join paper sheets. The final profile of connecting member 28, after forming and connecting two adjacent baskets, is shown in FIG. 1.

Figure 4A:
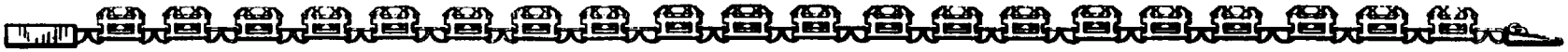
FIG. 4A is an end view of a completed bracelet of the type shown in FIG. 1 while 4B is the top view of the completed bracelet.
Figure 4B:
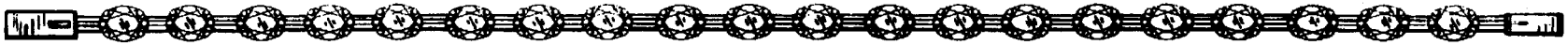

The ends of legs 34 are touching, end to end, beneath base 32 and when bent by the metal forming machine, the lower portions of ends 34 are aligned with each other as shown in FIGS. 4A and B.

As may be understood, the individual basket settings may be joined together without the use of soldering which is in the conventional and prior art manner of joining basket settings. In view of the automated nature of the metal forming process employed with the connectors and basket settings, a large number of such settings can be joined together quickly without requiring highly skilled jewelers. This causes a significant reduction in the labor costs of assembling bracelets, necklaces and the like, and it is anticipated that such articles of manufacture and the method will find widespread employment throughout the jewelry industry. After connecting the basket settings together, the jewels are secured in place by bending the tips of the prongs 24 over the jewels.

While this invention has been described with reference to a preferred embodiment, other modifications may be made to this invention without departing from the spirit and scope of the invention as set forth in the appended claims.

What is claimed is:

1. An article of manufacture for forming a jewelry item comprised of basket settings for holding a jewelry stone, the basket settings joined together to form a plurality of aligned and linked basket settings, said article comprising:

a basket setting having opposite ends and sides, with the stone to be held in a basket section formed by such ends and sides, each of said ends of said basket setting comprising rail members; and a connector member linking adjoining basket settings to one another, said connector member comprising a base and a pair of extending leg members from said base, said leg member being passed through a hole defined between said rail members to connect adjacent pairs of said basket settings, wherein said connector members are secured to said basket settings by press fitting.

2. An article of manufacture according to claim 1, wherein said rail members are basically parallel.

3. An article of manufacture according to claim 1, wherein said connector member is formed of a bendable metal.

4. An article of manufacture according to claim 1, wherein said leg members pass through the hole defined by said rail members, with the ends of said leg members bent to touch the bottom of said base of said connector member.

5. An article of manufacture according to claim 4, wherein said ends of said leg members are bent upwardly to touch each other and thereby form a V-shape beneath the base of said connector member.

6. An article of manufacture according to claim 1, wherein said connector member is approximately half as wide as the distance between the sides of said basket setting.

7. An article of manufacture according to claim 1, wherein said connector member is approximately 75% as wide as the distance between the sides of said basket setting.

8. An article of manufacture according to claim 1, wherein said rail members of said basket setting comprise an upper rail member and a lower rail member, said leg member of said connector member being passed between said upper rail member and said lower rail member.

9. An article of manufacture according to claim 8, wherein said upper and lower rail members are joined together by vertical members, said leg member of said connector member being passed between adjacent of said vertical members and between said upper and lower rail members.

10. An article of manufacture according to claim 8, wherein said upper and lower rail members are ring-shaped.

* * * * *